US005502982A

United States Patent [19]

Venetucci

[11] Patent Number: 5,502,982

[45] Date of Patent: Apr. 2, 1996

[54] CRYOGENIC TIE PIN

[75] Inventor: Jim M. Venetucci, Forest Park, Ill.

[73] Assignee: Liquid Carbonic Industries Corporation, Chicago, Ill.

[21] Appl. No.: 234,576

[22] Filed: Apr. 28, 1994

[51] Int. Cl.[6] ..... F25D 17/02

[52] U.S. Cl. ..... 62/374; 312/236; 312/406; 403/408.1; 411/384; 411/389

[58] Field of Search ..... 62/63, 374, 375, 62/380, 45.1; 403/408.1; 411/383, 384, 389; 312/236, 406

[56] References Cited

U.S. PATENT DOCUMENTS

| | | | |
|---|---|---|---|
| 1,640,433 | 8/1927 | Weldon | 411/389 |
| 2,586,556 | 2/1952 | Mullikin | 411/389 |
| 3,022,637 | 2/1962 | Morrison | 62/374 |
| 3,312,076 | 4/1967 | Clarke et al. | 62/45.1 |
| 3,331,525 | 7/1967 | Coehn . | |
| 3,401,816 | 3/1968 | Witt . | |
| 3,494,140 | 2/1970 | Harper et al. | 62/374 |
| 3,580,000 | 5/1971 | Wagner . | |
| 3,670,917 | 6/1972 | Nishimaki et al. . | |
| 3,855,811 | 12/1974 | Sauerbrunn et al. | 62/45.1 |
| 3,862,700 | 1/1975 | Noma et al. . | |
| 3,999,820 | 12/1976 | Haag | 312/406 |
| 4,033,142 | 7/1977 | Schorsch et al. . | |
| 4,050,609 | 9/1977 | Okamoto et al. . | |
| 4,065,019 | 12/1977 | Letourneur et al. . | |
| 4,106,424 | 8/1978 | Schuler et al. . | |
| 4,117,947 | 10/1978 | Androulakis . | |
| 4,190,305 | 2/1980 | Knight et al. | 312/406 |
| 4,480,513 | 11/1984 | McCauley et al. | 411/389 |
| 4,515,496 | 5/1985 | McKay | 403/408.1 |
| 4,584,849 | 4/1986 | Cloudy et al. . | |

*Primary Examiner*—Ronald C. Capossela
*Attorney, Agent, or Firm*—Lee, Mann, Smith, McWilliams, Sweeney & Ohlson

[57] ABSTRACT

A cryogenic freezing tunnel having a conveyer belt, insulated panels, each panel comprised of an inner metal surface layer, a wooden layer, a foam insulation layer, an outer metal surface layer, and tie pins connecting the outer and inner metal surface layers together, thereby, preventing void spaces between the inner metal layers and the wooden layers of the panels, which leads to ice build-up and bulging of the inner metal surface which forces collection pans and conveyer belt supports mounted on top the inner metal surfaces upward into the conveyer belt and consequently causes damage to the collection pans, conveyer belt supports, and conveyer belt.

17 Claims, 2 Drawing Sheets

CRYOGENIC TIE PIN

BACKGROUND OF THE INVENTION

This invention generally relates to insulation panels for low temperature liquified gas cryogenic freezing tunnels and spirals. Cryogenic freezing tunnels are used for freezing food products. A tunnel is composed of elongated insulted panels and a conveyer belt mounted inside and to the floor of the tunnel. Food products which move through the tunnel on the conveyer belt are quickly frozen by contact with liquid nitrogen or other cryogenic liquid sprayed from over head spray headers mounted in the tunnel as the food products pass through the tunnel on a conveyer belt.

The spray headers are located on the inside ceiling of the tunnel. These spray headers release liquid nitrogen $N_2$ or other cryogenic media onto the food products passing below on the conveyer belt. The liquid nitrogen contacting the food quickly freezes the food. The remainder of the liquid nitrogen falls onto collection pans located below the conveyer belt and vaporizes.

The walls of the tunnel are made from insulated panels. The insulted panels of the tunnel are made from multiple layers of material. These layers of materials include an outside layer of metal, a thick layer of foam insulation adjacent the outside metal layer, a layer of plywood abutting the foam insulation, and an inside metal skin abutting the plywood. The conveyer belt has conveyer belt supports mounted onto the inside skin of the floor of the tunnel. The collection pans are mounted to the floor of the insulated tunnel. This construction allows food to be frozen quickly as the food travels on the conveyer belt through the tunnel.

However, in operation several problems may arise. Air tends to accumulate in void spaces between the plywood and inside metal skin due to openings in welded seams or cracks. The accumulation of the air has the potential of condensing into oxygen due to the temperature differentials between the inside of the freezer tunnel and the void spaces. The moisture in the air condenses and transforms into ice crystals which steadily expand in size.

When air having moisture in it infiltrates the void spaces in the panel, two different conditions occur. First, the moisture condenses due to the extreme difference in temperature and transforms into ice, constantly increasing in size until the panels buckle, damaging the weld seams thereby, allowing more air to enter the void spaces causing even larger blocks of ice to form. This cycle repeats itself causing further damage to the freezer tunnel. This expansion of $H_2O$ causes ice build-up between the plywood and inside metal skin, therefore causing bulging of the external surfaces of the inside metal skin, as well as cracking of the welded seams. Since both the collection pans and support brackets are mounted on the inside metal skin, the collection pans and support brackets are forced upward by the bulging of the external surfaces of the inside metal skin, thereby, forcing the collection pans and conveyer belt supports upward into the conveyer belt causing belt damage, breakage of conveyer belt supporting frames, thereby, resulting shutdown of the cryogenic freezer tunnel.

The second condition can occur when the internal freezer temperature approaches cryogenic temperatures of–280° F. to –320° F., thereby, causing air in the void spaces to separate into oxygen and nitrogen. This concentration of oxygen in the void spaces can contribute to the combustion of the insulation.

In accordance with the present invention, the problems of ice build-up and bulging of the inside metal skin can be alleviated by connecting the outer metal skin and the inner surface of the freezer with cryogenic tie pins. The tie pins act to keep the inner metal skin compressed against the wooden layers in the panels, and thereby, limits the number of void spaces between the inner surface and wooden layer. Consequently, this limits ice build up beneath the inner surface which causes bulging and consequential break down of the conveyer belt. Additionally, seams created by connecting the panels together are welded together to prevent breathing of air within the insulated chamber, thereby, further minimizing condensing of moisture. Also, the problem of the combustion of foam insulation is minimized. The cryogenic tie pins have low thermal conductivity. The low conductivity of the tie pins minimizes heat loss and formation of ice on the ends of the tie pins.

DESCRIPTION OF PREFERRED EMBODIMENT

Figure 1:
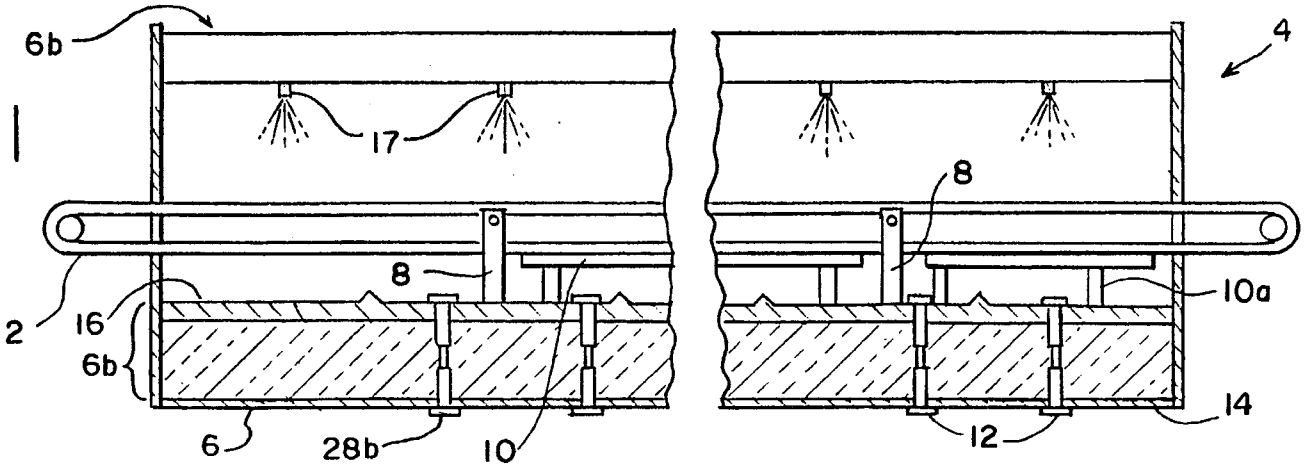
FIG. 1 is a sectional view of the bottom panel of a cryogenic freezer tunnel having cryogenic tie pins, and also showing collection pans mounted thereto, and a conveyer belt mounted thereto.

Referring to FIG. 1, a conveyer belt 2 is mounted inside a cryogenic freezer tunnel 4. The tunnel 4 is comprised of four insulated panels 6, those panels being two side panels 6*c*, a top panel 6*a*, and a bottom panel 6*b*. The conveyer belt 2 is mounted to the bottom panel 6*b* by conveyer belt supports 8. Also, mounted to the bottom panel 6*b* are collection pans 10. Attached to the collection pans 10 are collection pan supports 10*a* which are directly attached to and supported by the bottom panel 6*b*. The insulated panels 6 have a plurality of tie pins 12 connecting outer surface 14 of the panels 6 with the inner surface 16 of the panels 6. Also, overhead sprayers 17 are mounted to the top panel 6*a*. The overhead sprayers 17 are used to release cryogenic liquids onto food moving on the conveyer belt 2.

Figure 3:
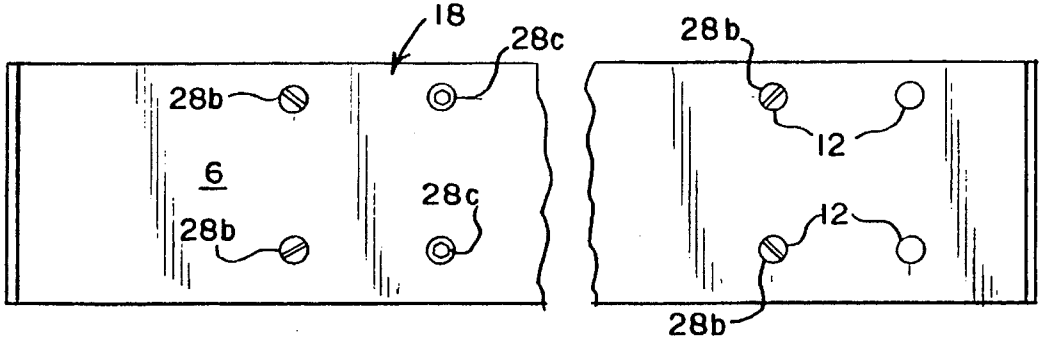
FIG. 3 is a top, side, or bottom view of a cryogenic freezer tunnel showing the outer surface and the heads of tie pins.
Figure 2:
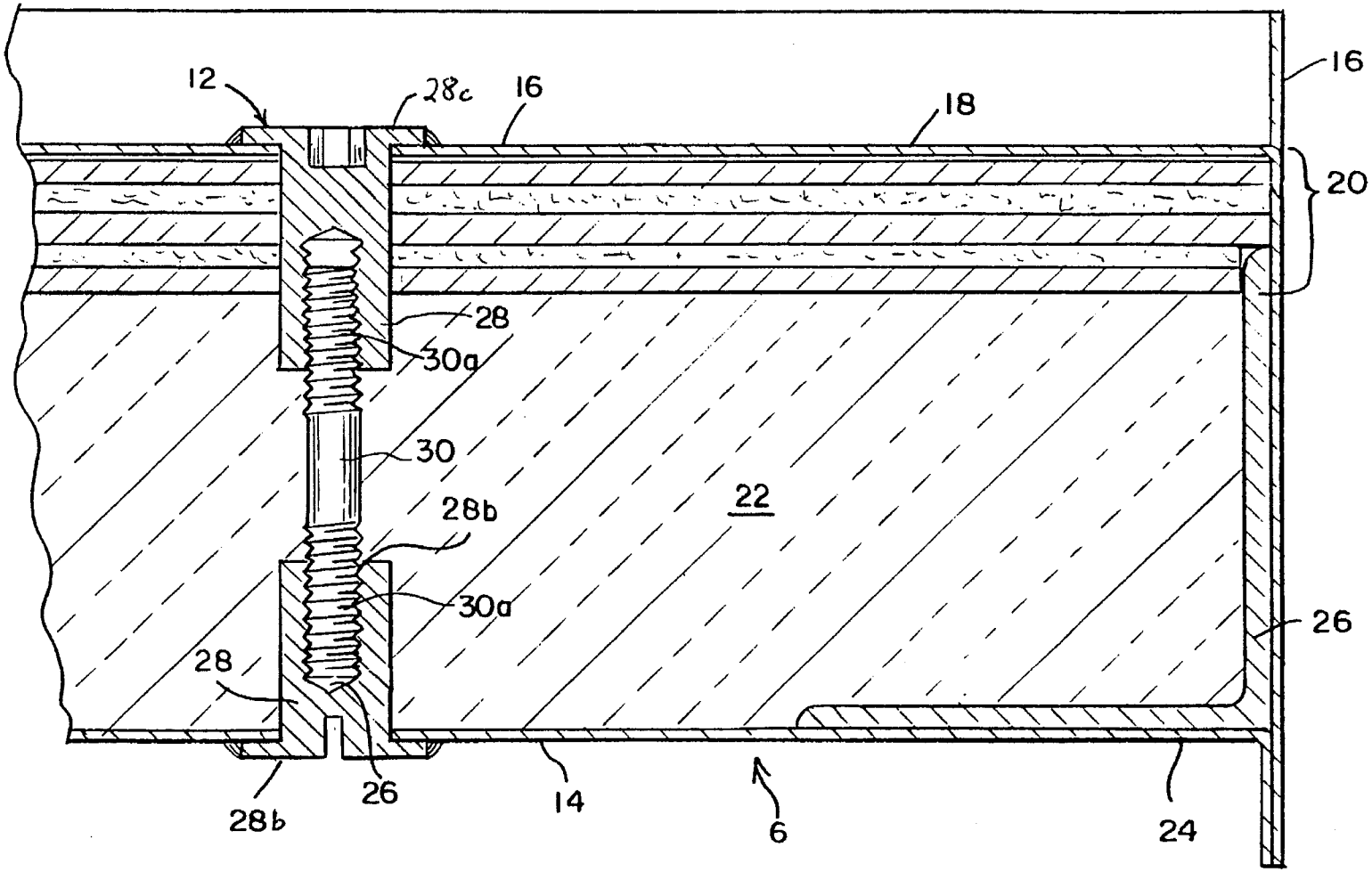
FIG. 2 is a sectional view of a cryogenic tie pin connecting the outer and inner surfaces of a cryogenic freezer panel together. Also shown is a sectional view of an L-Shaped panel reinforcement.

As better seen in FIG. 2, is an insulated panel 6 having a cryogenic tie pin 12 connecting the outer surface 14 of the panels 6 with the inner surfaces 16 of the panels 6. The panel 6 is comprised of a metal inner skin 18, against a layer of plywood 20, the plywood 20 abuts against a layer of foam insulation 22, the foam insulation 22 is enclosed by a metal outer skin 24. Each panel 6 has L-Shaped reinforcements 26 extending adjacent and along the inside edges of the outer skin 24. The layers 18, 20, 22 and 24 of the insulated panel 6 are connected together by tie pins 12. The tie pins 12 consist of two threaded female portions 28 and a threaded male rod 30. The female portions 28 have a head 28*a* at one end and a threaded opening 28*b* at the other end. The head 28*a* of the female portion 28 may have a slotted head 28*b* as seen in FIGS. 2-3, or the female portion 28 may have a keyed opening 28*c* as seen in FIG. 2-3.The male rod 30 is threaded at each end 30*a*, with each end 30*a* adapted to be screwed into the threaded opening 28*b* of a female portion 28. The layers 18, 20, 22 and 24 of the insulted panel 6 are compressed together by twisting either of the two female portions 28 of a tie pin 12 around the male rod 30, thereby, compressing layers 18, 20, 22 and 24 together. After compressing the layers 18, 20, 22 and 24 together, the heads 28*a* of the female portions 28 of each tie pin are welded to the surfaces of the metal inner 18 and outer skins 24 (also see FIG. 3).

Figure 4:
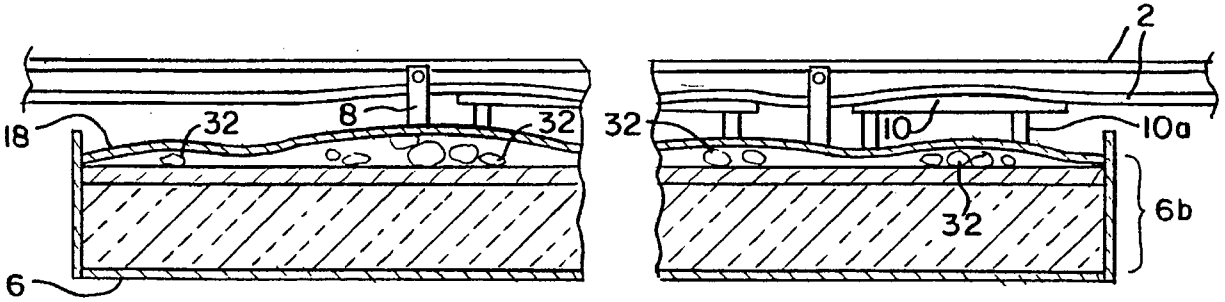
FIG. 4 is a sectional view of the bottom panel of a cryogenic freezer tunnel not having cryogenic tie pins, and having bulges created by ice build up between the inner skin of the panel and the plywood, also showing collection pans forced upward into bottom of conveyer belt and conveyer belt supports forced upward.

As see in FIG. 4, when cryogenic tie pins 12 are not used, ice 32 develops between the inner skin 18 and the plywood 20 causing the inner skin 18 to buckle and push outward. The collection pans 10 mounted on the inner skin 18 are forced outward into the conveyer belt 2. The ice build up 32 under the inner skin 18 also forces the conveyer belt supports 8 upward to where the conveyer belt 2 becomes distorted.

What is claimed is:

1. A cryogenic freezing tunnel wherein said tunnel has overhead sprayers for releasing cryogenic liquids onto foods, and insulated panels, each panel being comprised of multiple layers of materials, a conveyor belt and a compressing means for compressing the layers of materials together, said compressing means comprising:

a rod having two rod ends made of material having low thermal conductivity for minimizing heat loss from said tunnel and formation of ice on said rod ends; and two female inserts made of material having low thermal conductivity, each said insert having a head portion and a female end, said female ends being connected to said rod ends.

2. A cryogenic freezing tunnel according to claim 1 wherein the two said rod ends are threaded, and said two female ends are threaded.

3. A cryogenic freezing tunnel according to claim 1 wherein the head portion of said female inserts have a slot.

4. A cryogenic freezing tunnel according to claim 1 wherein the head portion of said female inserts has a keyed opening.

5. A cryogenic freezing tunnel according to claim 1 wherein said rod is non-metallic.

6. A cryogenic freezing tunnel according to claim 1 wherein said panels are welded together.

7. A cryogenic freezing tunnel having overhead sprayers for releasing cryogenic liquids on to foods, wherein said tunnel also has insulated panels and a conveyor belt, said insulated panels comprising:

an outer skin layer abutting against a foam insulation layer; said foam insulation layer abutting against a wood layer, said wood layer abutting against an inner skin layer; and a plurality of cryogenic tie pins, each said tie pin being made of material having low thermal conductivity and having a rod and two female inserts, each said insert having a head portion and a female end, said female ends being connected to said rod ends, said tie pins connecting said outer skin to said inner skin layer.

8. A cryogenic freezing tunnel according to claim 7 wherein the two said rod ends are threaded, and said two female ends are threaded.

9. A cryogenic freezing tunnel according to claim 7 wherein the head portion of said female inserts have a slot.

10. A cryogenic freezing tunnel according to claim 7 wherein the head portion of said female inserts has a keyed opening.

11. A cryogenic freezing tunnel according to claim 7 wherein said rod is non-metallic.

12. A cryogenic freezing tunnel according to claim 7 wherein said panels are welded together.

13. A cryogenic tie pin made of material having low thermal conductivity for minimizing heat loss and ice formation on said pins, comprising:

a rod made of said material having low thermal conductivity, said rod having two rod ends: and two female inserts made of said material having low thermal conductivity, said inserts having a head portion and a female end, said female ends being connected to said rod ends.

14. A cryogenic tie pin according to claim 13 wherein said two rod ends are threaded, and said two female ends are threaded.

15. A cryogenic tie pin according to claim 13 wherein the head portion of said female inserts have a slot.

16. A cryogenic tie pin according to claim 13 wherein the head portion of said female inserts has a keyed opening.

17. A cryogenic freezing tunnel according to claim 13 wherein said rod is non-metallic.

* * * * *